United States Patent [19]

Amani

[11] 4,325,504

[45] Apr. 20, 1982

[54] MAGNETIC DEVICE ADAPTED TO BE WORN ON THE ARM OR WRIST FOR HOLDING NAILS AND THE LIKE

[76] Inventor: Nader Amani, 1122 S. Highland Ave., Oak Park, Ill. 60304

[21] Appl. No.: 216,797

[22] Filed: Dec. 16, 1980

[51] Int. Cl.[3] ..... A45F 5/00

[52] U.S. Cl. ..... 224/183; 224/170

[58] Field of Search ..... 224/183, 902, 170

[56] References Cited

U.S. PATENT DOCUMENTS 2,176,052 10/1939 Beyer ..... 224/183 X
2,182,830 12/1939 Vedder ..... 224/170 X
2,597,601 5/1952 Sherman ..... 224/183 X

FOREIGN PATENT DOCUMENTS 851292 1/1940 France ..... 224/183
649678 1/1951 United Kingdom ..... 224/183

*Primary Examiner*—Steven M. Pollard
*Attorney, Agent, or Firm*—McCaleb, Lucas & Brugman

[57] ABSTRACT

A magnetic device adapted to be worn on the arm or wrist for holding magnetizable items such as nails and the like. The device includes a contractible bracelet or band of elastic, perspiration-absorbent fabric material having a magnet supported externally on it. The magnet has pole pieces with exposed, coplanar outer faces. A relatively soft collar of rubber-like cushioning material encircles the magnet. The pole faces of the magnet and the interface of the collar are substantially coplanar. A separate magnetizable keeper plate is engageable with the exposed magnet outer faces to maintain the power of the magnet while the device is out of use for extended periods.

3 Claims, 7 Drawing Figures

Fig. 1.
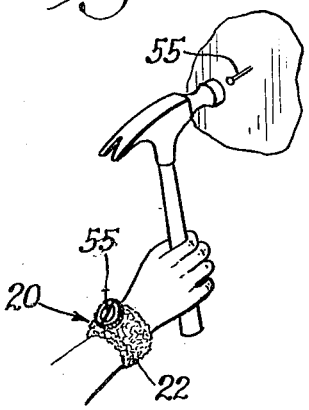
Fig. 2.
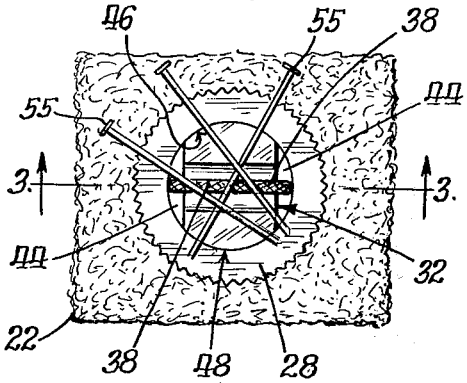
Fig. 5.
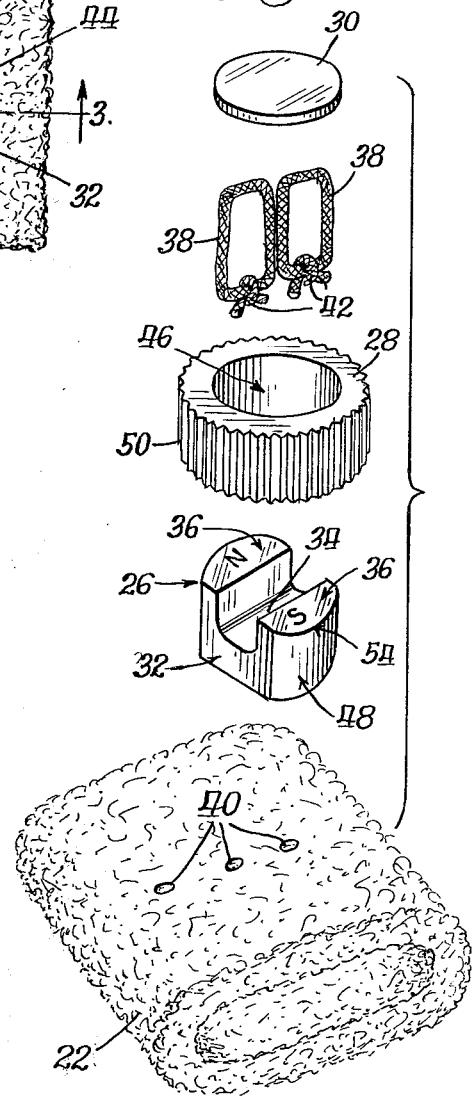
Fig. 3.
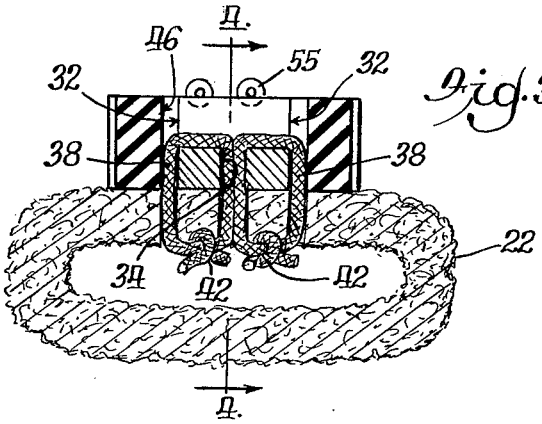
Fig. Д.
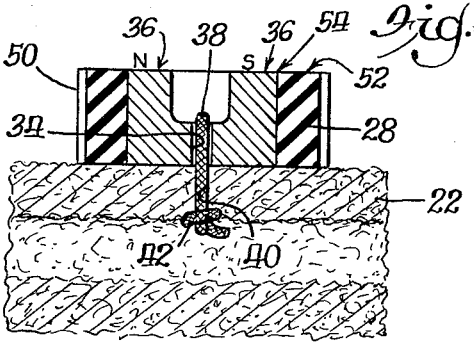
Fig. 7.
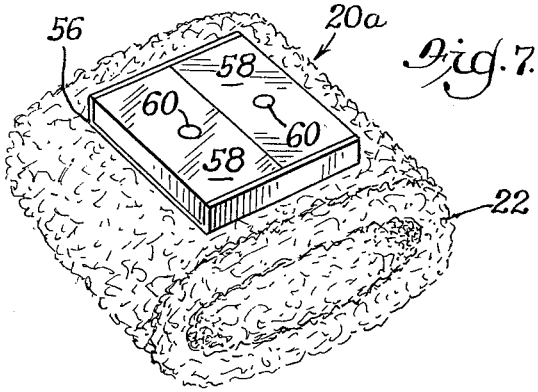
Fig. 6.
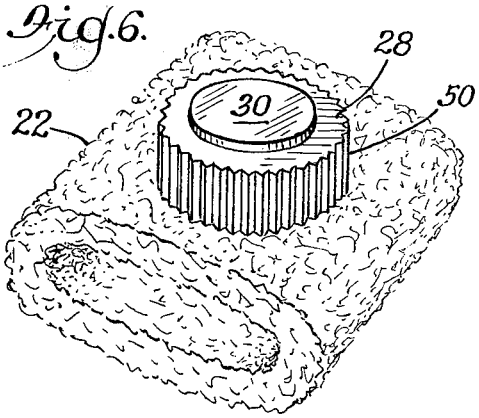

MAGNETIC DEVICE ADAPTED TO BE WORN ON THE ARM OR WRIST FOR HOLDING NAILS AND THE LIKE

BACKGROUND OF THE INVENTION

This invention relates generally to hand tools. More specifically it relates to a band which can be worn as a bracelet and which has an external magnet for holding a supply of magnetizable items such as nails and the like.

A problem well-known to carpenters exists where one has to drive large numbers of nails, particularly in a wall or ceiling or other elevated location. The problem is that of providing a continuous supply of nails from a main container such as a keg or box. Starting a nail is a two-handed operation, one to hold the nail, and the other to give it an initial blow with a hammer. During this starting procedure, it is awkward to hold more than one nail at a time because both hands are in use. Much of this nailing work is done on a ladder or scaffold which does not provide a convenient or safe place for a nail container. For this reason, the container is usually placed somewhere near the bottom of the ladder, or on the scaffold platform near the working place, requiring the carpenter to make frequent trips up and down the ladder, or across the platform, for fresh supplies of nails. This is inefficient. A carpenter will sometimes try to reduce the number of trips by holding nails in his mouth. This is dangerous, especially where the nails are sharp or small enough to be swallowed. This situation is accordingly in need of improvement.

SUMMARY OF THE INVENTION

Therefore, a principal object of the present invention is to provide a bracelet-like device with a magnet which can be worn on a user's arm or wrist to hold a supply of nails and the like for immediate availability at the point of use.

Another object is to provide such a device in which the magnet has opposite pole pieces with exposed outer faces directly engageable with nails and the like so a substantial number of nails may be stored for ready access on the user's arm or wrist.

Another object is to provide such a device with a relatively soft collar of rubber-like cushioning material encircling the magnet to protect it from striking external objects when it is worn on the user's hammer arm.

Another object is to provide such a device in which the outer surfaces of the magnet pole pieces and the collar are substantially coplanar to thereby combine maximum holding power for the magnet with maximum cushioning protection against hard edges of the magnet.

Another object is to provide such a device with a magnetic keeper to engage the exposed magnet outer face to maintain the power of the magnet while the device is out of use for extended periods.

Another object is to provide such a device in which the bracelet is made of elastic, perspiration-absorbent fabric material to grip different arm or wrist sizes and to prevent slipping and turning if the user perspires in hot weather use.

To accomplish the above and related objects, this invention may be embodied in the forms illustrated in the accompanying drawings, attention being called to the fact, however, that the drawings are illustrative only, and that changes may be made in the specific constructions illustrated and described within the scope of the appended claims.

Other objects and advantages of the invention will be apparent from the following description taken in connection with the accompanying drawing.

BRIEF DESCRIPTION OF THE DRAWING

FIG. 1 is a view of a user's arm showing one form of the device according to the present invention in use;

FIG. 2 is a top, plan view of the device shown in FIG. 1;

FIG. 3 is a transverse, cross-sectional view of FIG. 2, taken on line 3—3;

FIG. 4 is a longitudinal cross-sectional view of FIG. 3, taken on line 4—4;

FIG. 5 is an exploded perspective view of the device shown in the previous figure;

FIG. 6 is a perspective view of the device with a magnetic keeper plate or disc assembled for storage; and FIG. 7 is a perspective view of an alternate form of the invention.

Like parts are designated by like reference characters throughout the figures.

DETAILED DESCRIPTION OF THE PREFERRED EMBODIMENTS

Referring now to the drawing in greater detail, the embodiment of the invention shown in FIGS. 1-6 is generally designated 20. It comprises a band 22 adapted to be worn as a bracelet on the arm or wrist, and a cushioned magnet assembly generally designated 24.

Any form of band, preferably non-magnetic, may be used. The band 22 here illustrated is endless and contractible, being formed of elastic, moisture-absorbing fabric. It may be similar to a form of athletic wrist band used by tennis players and others, made of perspiration-absorbing, terry-cloth-like material which keeps it from slipping or turning when the user swings his hammer arm. Other kinds of bands, elastic or non-elastic, endless or not, or a strap with a buckle may be used as desired.

The cushioned magnet assembly 24 comprises a magnet 26, a cushion collar 28, and a keeper 30. An "Alnico" magnet has been found to provide very satisfactory results.

The magnet 26 is U-shaped as shown in FIGS. 4 and 5, with opposite poles N and S. In the views shown in FIGS. 2 and 3, the magnet is circular in cross-section, with diametrically opposed flats 32, 32. A central, axial opening 34 is provided in the base of the magnet. The outer faces 36 of the magnet poles N and S are flat and coplanar. The magnet is supported on the outside of the band 22 and held in place by cords 38, 38 extending along the flats 32, through the magnet center opening 34, and through a line of openings 40 in the band where they are held by knots as indicated at 42. As shown in FIG. 2, the flats 32 provide a convenient means for threading the cords through the assembly while maintaining them substantially hidden within the spaces 44 between the flats and the inner wall 46 of the cushion collar 28.

The collar 28 is annular in shape, being made of elastic, rubber-like material such as neoprene and encircles the magnet 26 with the inner cylindrical wall 46 engaging the outer cylindrical wall 48 of the magnet. In the example shown, the external collar surface 50 is vertically ribbed, but it may be plain, or have some other form of decorative or utilitarian contour. The collar may be held by friction, or, alternatively, it may be permanently fastened to the magnet by adhesive or by vulcanizing. As best shown in FIG. 4, the top surfaces 36 of the magnet poles are coplanar with the top surface 52 of the cushion collar 28. This exposes the magnet pole surfaces 36 for maximum holding power on nails 55, while providing maximum protection against the sharp upper corner 54 of the magnet inadvertently striking an object when swung by the user's hammer arm.

The keeper 30 is a flat, circular plate or disc approximately the diameter of the magnet, made of some magnetizable metal such as iron. It is placed across the poles as shown in FIG. 6 to maintain the power of the magnet whenever the device is out of use for extended periods.

The alternate embodiment 20*a* illustrated in FIG. 7 is similar to the embodiment shown in the previous figures. The band 22 may be identical, but the magnet assembly is square or rectangular, has a larger area to hold more nails, and a somewhat lower profile. It comprises a U-shaped bracket 56, preferably of non-magnetic material such as brass or plastic, and a pair of flat, rectangular magnets 58, 58. These may be of "Alnico" or ceramic material, according to the strength desired. Their magnetic orientation is optional; one may have its south pole up while the other has its south pole down; or the north and south poles may be uppermost or at opposite ends of the individual magnets. Rivets 60, 60 extend through the magnets 58, bracket 56, and band 22 to hold these components assembled as shown.

While not specifically shown, the alternate embodiment in FIG. 7 may utilize a cushion collar encircling it, and a square keeper plate. These components may be similar to cushion collar 28 and keeper 30 respectively except that they would be square or rectangular in shape In use, the device is preferably worn on the hammer arm near or on the wrist as shown in FIG. 1. This leaves the other hand free to place a nail and hold it for the initial hammer blow, while a supply of fresh nails are held on the magnet readily accessible to the non-hammer hand for the next nailing, and the next, etc. With a good grade of magnet, the supply of nails held thereby will not be dislodged even when the hammer is swung widely and impacted against the nail heads in normal nailing operations.

To replenish the supply of nails, the user merely turns his arm over and dips the magnet pole faces into the keg or box containing the main supply of nails, and withdraws it with a fresh working supply.

The device also has a high degree of utility for use with other magnetizable items where a substantial working supply is needed near a point of use but one or both hands must be kept free. Examples are screws, paper clips, and staples.

While certain novel features of this invention have been shown and described and are pointed out in the annexed claims, it will be understood that various omissions, substitutions and changes in the forms and details of the device illustrated and its operation can be made by those skilled in the art without departing from the spirit of the invention.

The embodiments of the invention in which an exclusive property or privilege is claimed are defined as follows:

1. In a magnetic device adapted to be worn on the arm or wrist for holding magnetizable items such as nails and the like, said device comprising in combination:

a bracelet band adapted to encircle the user's arm or wrist; and a circular magnet of U-shaped cross-section supported on the bracelet band and having bare coplanar north and south poles in a plane generally parallel to the bracelet band facing outwardly to attract nails and the like and to retain them readily available to the user;

the improvement comprising a relatively soft annular collar of rubberlike cushioning material encircling and coplanar with the magnet below its outer face to protect the magnet from striking external objects.

2. The combination of claim 1 wherein the outer surfaces of the magnet and collar are substantially coplanar to expose the magnet outer face while protecting the outer edge of the magnet below the outer face from striking external objects.

3. The combination of claim 1 in which the bracelet band is made of elastic, perspiration-absorbent fabric material contractible onto the user's arm or wrist.

* * * * *